US007599814B2

(12) United States Patent
Tinker et al.

(10) Patent No.: US 7,599,814 B2
(45) Date of Patent: Oct. 6, 2009

(54) SYSTEM AND METHOD FOR COMPUTING REACHABLE AREAS

(75) Inventors: Peter A. Tinker, West Hills, CA (US); David W. Payton, Calabasas, CA (US)

(73) Assignee: HRL Laboratories, LLC, Malibu, CA (US)

( * ) Notice: Subject to any disclaimer, the term of this patent is extended or adjusted under 35 U.S.C. 154(b) by 10 days.

(21) Appl. No.: 11/413,925

(22) Filed: Apr. 27, 2006

(65) Prior Publication Data

US 2007/0255524 A1 Nov. 1, 2007

(51) Int. Cl.
*G01C 17/00* (2006.01)
*G01B 11/28* (2006.01)

(52) U.S. Cl. ..... 702/153; 702/154; 702/155; 702/156; 345/419; 345/420; 345/422; 345/426; 345/589

(58) Field of Classification Search ..... 702/153–158, 702/188–198, 151, 152; 345/419, 421, 425, 345/427, 581, 619, 420, 422, 426, 589; 244/3.1; 701/208

See application file for complete search history.

(56) References Cited

U.S. PATENT DOCUMENTS 3,028,807 A 4/1962 Burton et al.
3,374,967 A 3/1968 Plumley
3,758,052 A 9/1973 McAlexander et al.
3,860,199 A 1/1975 Dunne
4,300,736 A 11/1981 Miles
4,898,340 A 2/1990 Kliger et al.
5,003,498 A * 3/1991 Ota et al. ..... 345/420
5,554,994 A 9/1996 Schneider
5,816,817 A 10/1998 Tsang et al.
6,169,516 B1 * 1/2001 Watanabe et al. ..... 342/357.13
6,292,106 B1 9/2001 Solinsky et al.
6,628,278 B1 * 9/2003 Ritter ..... 345/419
2002/0045999 A1 * 4/2002 Bollweg et al. ..... 702/158

* cited by examiner

*Primary Examiner*—Eliseo Ramos Feliciano
*Assistant Examiner*—Phuong Huynh
(74) *Attorney, Agent, or Firm*—Tope-McKay & Assoc.

(57) ABSTRACT

The present invention relates to computing reachable areas given a first point. More specifically, the present invention relates to the computation of an intersection between a first surface and a second surface for determining a set of points that are reachable from a first point. Using the present invention, a user can determine either (1) a locus of target sites that can be struck by a ballistic projectile from a given launch site, or (2) a locus of launch sites that can be used to hit a given target site. The disclosed system and method employs graphics hardware to determine an intersection between a first surface defined by trajectory paths, and a second surface defined by terrain.

27 Claims, 9 Drawing Sheets

SYSTEM AND METHOD FOR COMPUTING REACHABLE AREAS

BACKGROUND OF THE INVENTION (1) Technical Field

The present invention relates to computing reachable areas given a first point. More specifically, the present invention relates to the computation of an intersection between a first surface and a second surface for determining a set of points that are reachable from a first point.

(2) Description of Related Art

Ballistic projectiles are fired from a specific location in a three-dimensional world, and are intended to strike a target at a different location. Ballistic projectiles may be launched by unmanned vehicles exploring distant planets, or by troops in combat. Sophisticated algorithms have been developed to determine, given a launch site, ballistic, and environmental conditions, the flight trajectory of the projectile. Other techniques can determine desired launch conditions, given a target site and a trajectory. However, these techniques generally require that a launch and target site are known. Further, these prior art systems generally compute a single target site from a single launch site, or vice versa. Thus, what is needed is a system and method, that allows a user to determine the entire region of candidate target sites that can be hit from a particular launch site, taking into account the various peaks and valleys in the local terrain that might create obstructions.

SUMMARY OF THE INVENTION

The present invention provides a method that overcomes the aforementioned limitations and fills the aforementioned needs by disclosing a method for determining an area that is reachable from a first point. The method comprises acts of obtaining a first surface and a second directional surface; determining a set of intersection points between the first surface and the second directional surface, wherein the set of intersection points has an order in a first dimension and a direction in a second dimension based on the directionality of the second directional surface; and determining a set of reachable points from the set of intersection points, wherein the set of reachable points has a point per order.

In another aspect, the act of obtaining a second directional surface further comprises an act of defining the second directional surface by a set of ordered curves in space, in which the projection onto a plane of interest is non-intersecting.

In yet another aspect, the act of defining further comprises an act of selecting the set of ordered curves in space from a set of trajectories.

Additionally, the act of selecting further comprises an act of determining the set of trajectories from a set of ballistic trajectories.

In another aspect, the act of obtaining a first surface comprises an act of selecting the first surface from a set of topological maps.

Furthermore, the act of obtaining further comprises an act of discretizing the first surface and the second directional surface, such that the first surface and the second directional surface comprises discrete points that represent the surfaces.

In yet another aspect, the act of determining a set of reachable points further comprises acts of mapping the set of intersection points into a rectangular grid corresponding to order and direction, wherein each intersection point has an order value and a direction value; and determining for each direction value the smallest order value, wherein the direction value and smallest order value comprises one of the reachable points in the set of reachable points.

In another aspect, the act of determining a set of intersection points comprises an act of determining whether and where the first surface intersects the second surface using a Z-buffer. The Z-buffer is implemented in software, firmware, or hardware.

In another aspect, the present invention comprises apparatus for computing reachable areas. The apparatus comprises:

a processor, wherein the processor comprises:

a trajectory engine; and a graphics engine connected with the trajectory engine; and a memory module connected with the processor, wherein the memory module comprises:

topographical map information; and a color buffer, wherein the processor comprises software for performing acts of:

defining a first surface from the trajectory engine;

rendering a topographical map from the topographical map information utilizing the graphics engine;

rendering the first surface utilizing the graphics engine; and eliminating shadowed images utilizing the color buffer.

In another aspect, the act of defining a first surface includes acts of selecting a starting and ending azimuth value; and varying an azimuth value between the starting and ending azimuth values.

In yet another aspect, the act of eliminating shadowed images includes acts of:

reading back the color buffer into the processor, wherein the color buffer contains pixels of a first color and a second color, wherein the first color represents elements where the topographical map has a lower Z value than the corresponding first surface, and the second color represents elements where the topographical map has a higher Z value that the corresponding first surface; determining a shadow from the point where the color buffer contains only the first color; and eliminating the areas in the shadow.

In another aspect, the apparatus comprises:

a processor, wherein the processor comprises:

a trajectory engine; and a memory module connected with the processor, wherein the memory module contains topographical map information, wherein the processor comprises software for performing acts of:

obtaining a first surface from the topographical information and a second directional surface from the trajectory engine;

determining a set of intersection points between the first surface and the second directional surface, wherein the set of intersection points has an order in a first dimension and a direction in a second dimension based on the directionality of the second directional surface; and determining a set of reachable points from the set of intersection points, wherein the set of reachable points has one point per order.

Finally, as can be appreciated by one skilled in the art, the present invention includes a computer program product having instruction means for causing a computer to perform the method described herein.

BRIEF DESCRIPTION OF THE DRAWINGS

The objects, features, and advantages of the present invention will be apparent from the following detailed descriptions of the several aspects of the invention in conjunction with reference to the following drawings, where.

DETAILED DESCRIPTION

Figure 1:
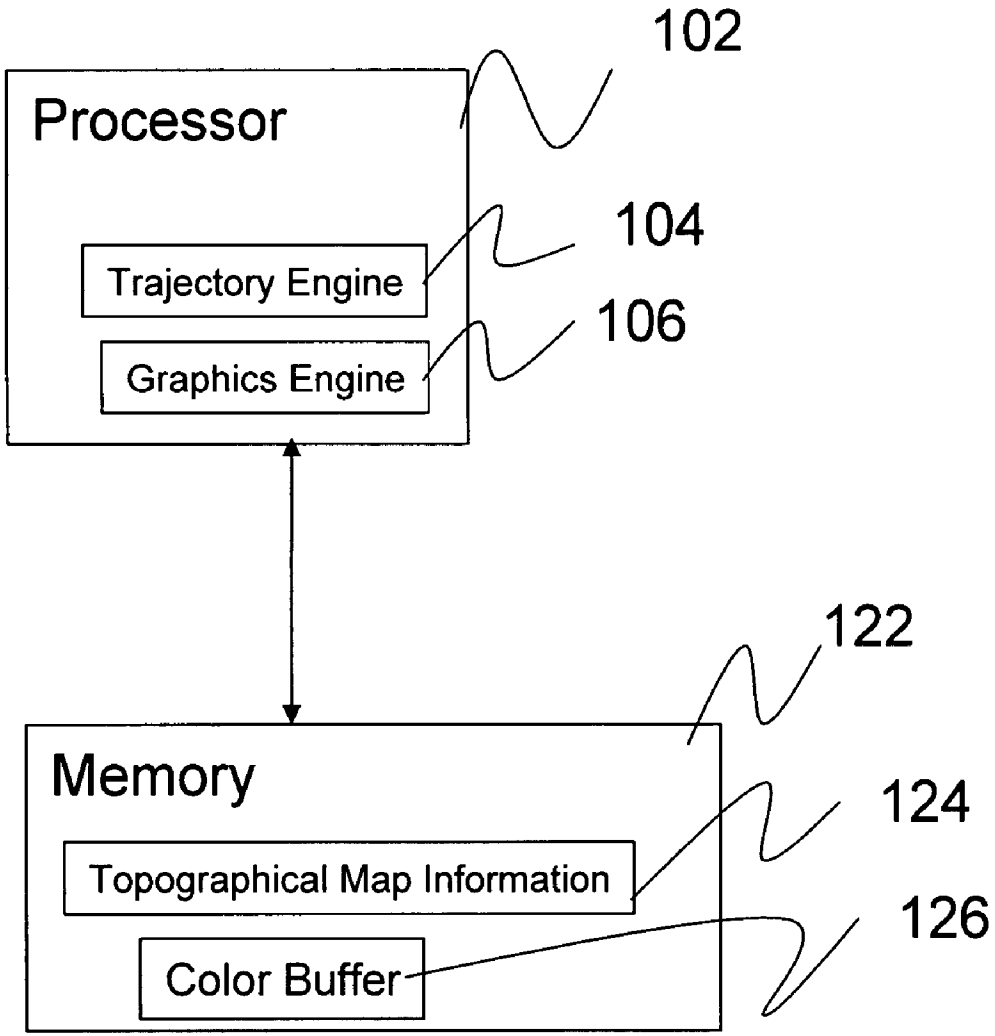
FIG. 1 is a block diagram of an aspect of the disclosed system and method according to the present invention.

The present invention relates to the computation of an intersection between a first surface and a second surface for determining a set of points that are reachable from a first point. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles, defined herein, may be applied to a wide range of embodiments. Thus, the present invention is not intended to be limited to the embodiments presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent, or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

(1) Details

The disclosed system and method enables the determination of either (1) a locus of target sites that can be struck by a ballistic projectile from a given launch site, or (2) a locus of launch sites that can be used to hit a given target site. The disclosed system and method employs graphics hardware to determine an intersection between a first surface defined by trajectory paths, and a second surface defined by terrain.

Some advantages of the disclosed system and method are that it enables the computation of potential launch or target areas, rather than just particular site points. Thus, planners can see the full range of launch or target areas at once, in order to schedule firing sequences. Further, the disclosed system and method may be useful in over-the-horizon ballistics situations where the results of prior firings might not be available. Finally, the disclosed system and method may allow for rapid computation of accessible target regions or candidate launch sites since the graphics hardware computes intersections between trajectory surfaces (i.e., a first surface) and terrain surfaces (i.e., a second surface). The result of the computation of the intersections is that fewer calls to a trajectory generation engine are needed because it is possible to interpolate a few trajectories into a contiguous surface, or area.

A block diagram of one embodiment of the disclosed system and method is shown in FIG. 1. The disclosed system and method comprises a processor 102 connected with a memory 122. One skilled in the art will appreciate that the processor 102 and memory 122 may be part of a larger computer system.

In one embodiment, the processor 102 comprises a trajectory engine 104 and a graphics engine 106. The memory 122 comprises topographical map information 124 and a color buffer 126. In one embodiment, the topographical map information is in digital form where elevations are associated with ground coordinates of an area of interest.

In one embodiment, the locus of target sites that can be struck by a ballistic projectile from a given launch site can be determined. In this embodiment, the launch site is known. A flow chart depicting actions taken by the processor 102 in determining the locus of target sites is shown in FIG. 2.

After a starting action 202, an action of determining a list of trajectories available from this launch site 204 is performed. In one embodiment, the list of trajectories may be obtained from the trajectory engine 104, shown in FIG. 1, by varying one launch variable over a range of values, and keeping the other launch variable constant. For example, the projectile-launching power, location, payload, and elevation may be kept constant while the azimuth may be varied across a range of values. A new trajectory would be computed for each azimuth value. One skilled in the art will appreciate that elevation, power, or any number of other variables may be adjusted in order to determine the list of trajectories.

Next, an act of defining a first surface 206 is performed by joining together parametrically similar points along each computed trajectory, forming a three-dimensional grid of points.

Figure 2:
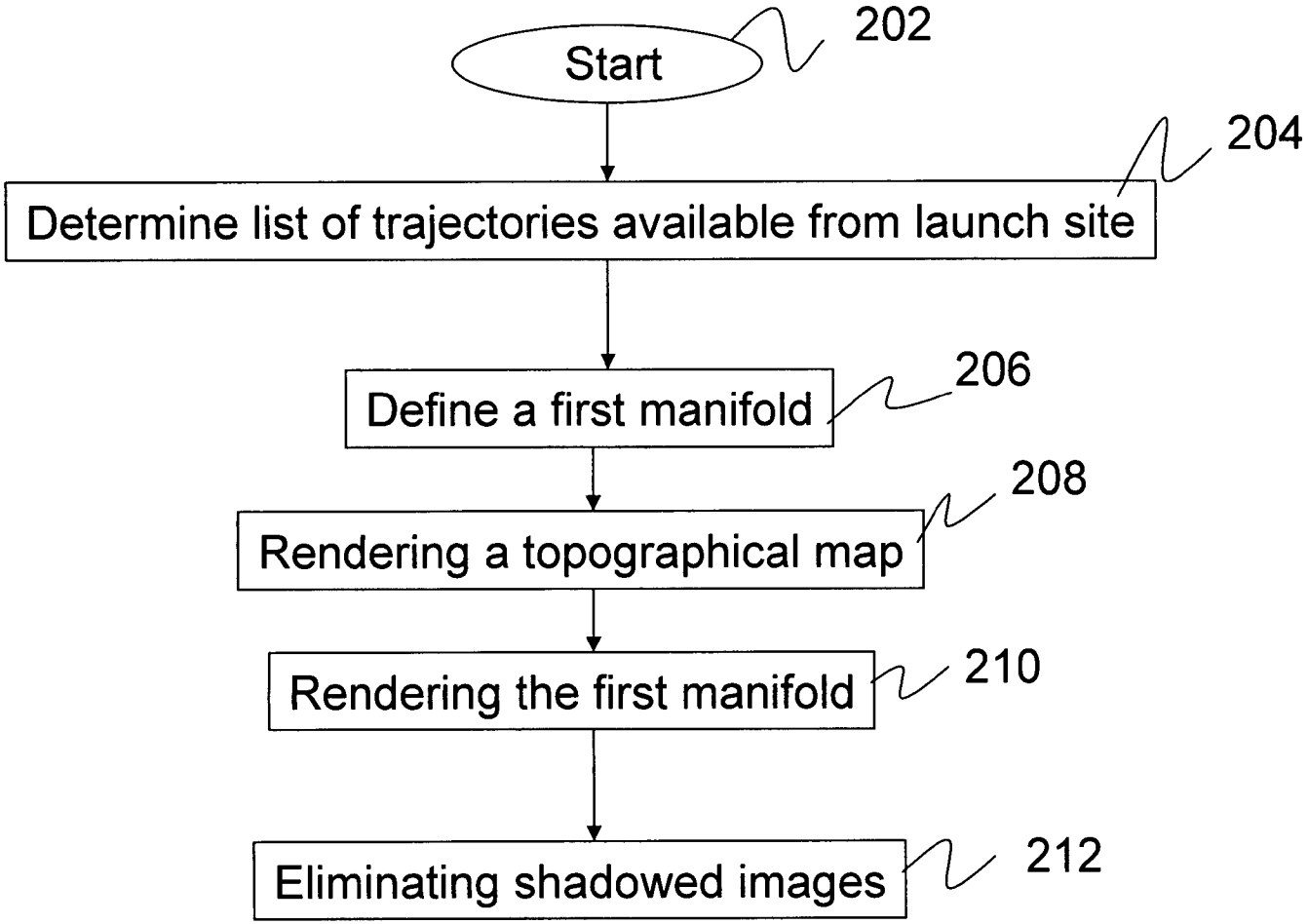
FIG. 2 is a flow chart depicting actions taken by a processor in determining the locus of target sites according to the present invention.
Figure 3:
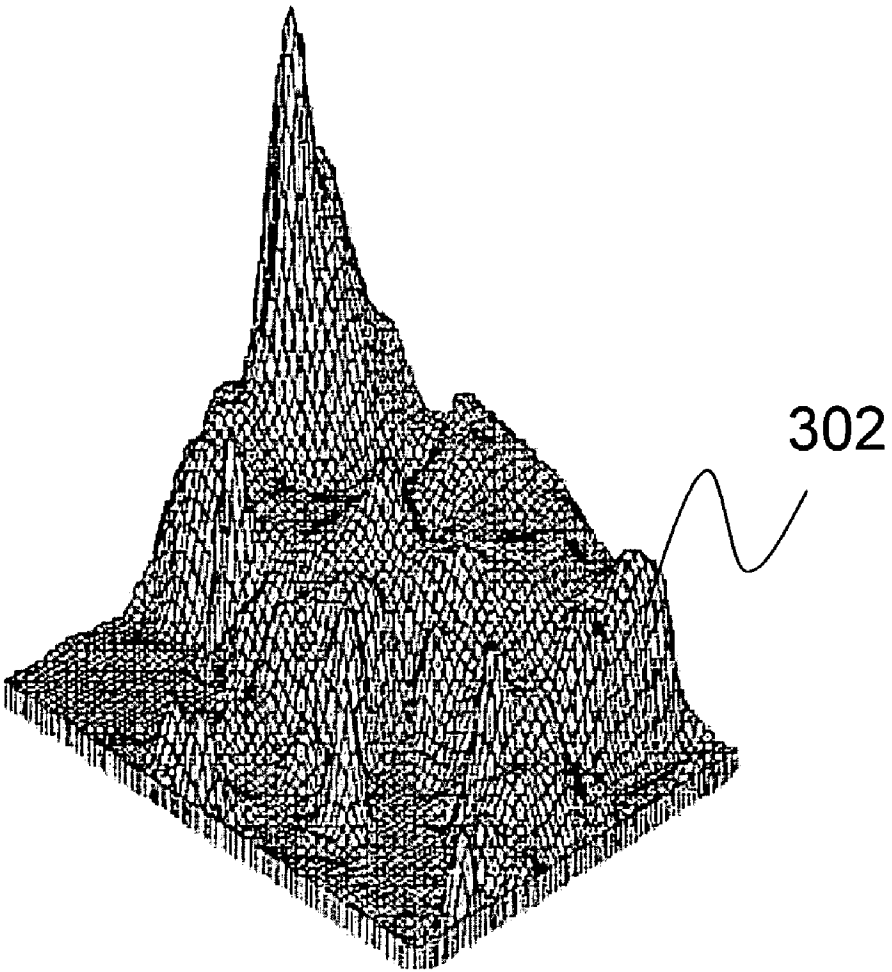
FIG. 3 is an exemplary illustration of a rendered topographical map surface.

As shown in FIG. 2, next an act of rendering (i.e., drawing) a topographical map surface 208 is performed. An oblique view of an example of a rendered topographical map surface 302 is shown in FIG. 3. In one embodiment, the topographical map surface 302 is rendered by the graphics engine 106, shown in FIG. 1, using orthographic projection. The topographical map surface 302 is rendered consisting of a set of pixels with three values each: x, y, and z, where, by convention, z is "into" the resulting image and is called depth. The graphics engine 106 maintains a "depth buffer" indicating which rendering primitive has the lowest z value at each (x, y) location. The "depth buffer" may be used to determine which graphical entities are obscured by others.

Figure 4:
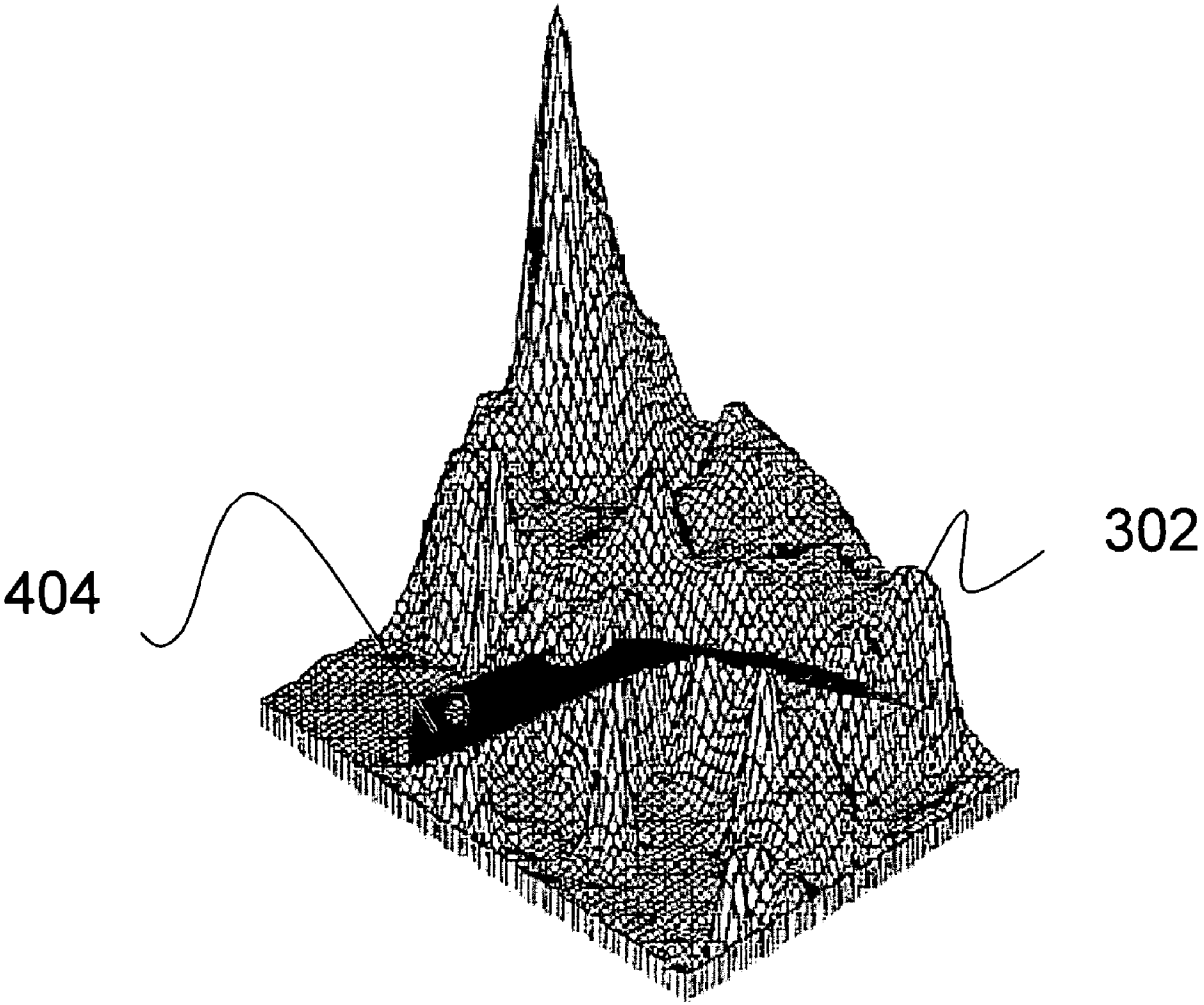
FIG. 4 is an exemplary illustration of a trajectory surface rendered in the same space as the topographical map surface.

Referring to FIG. 2, next an act of rendering the first surface 210 (herein referred to as the trajectory surface) in the same space as the topographical map surface is performed. FIG. 4 depicts the trajectory surface 404 rendered in the same space as the topographical map surface 302. A "depth buffer" reveals whether and where the topographical map surface 302 intersects the trajectory surface 404. Where the trajectory surface 404 hits the topographical map surface 302, only the topographical map surface 302 is visible, where the trajectory surface 404 lies above the topographical map surface 302, only the trajectory surface 404 is visible. The topographical map surface 302 "cuts holes" in the trajectory surface 404.

Figure 5:
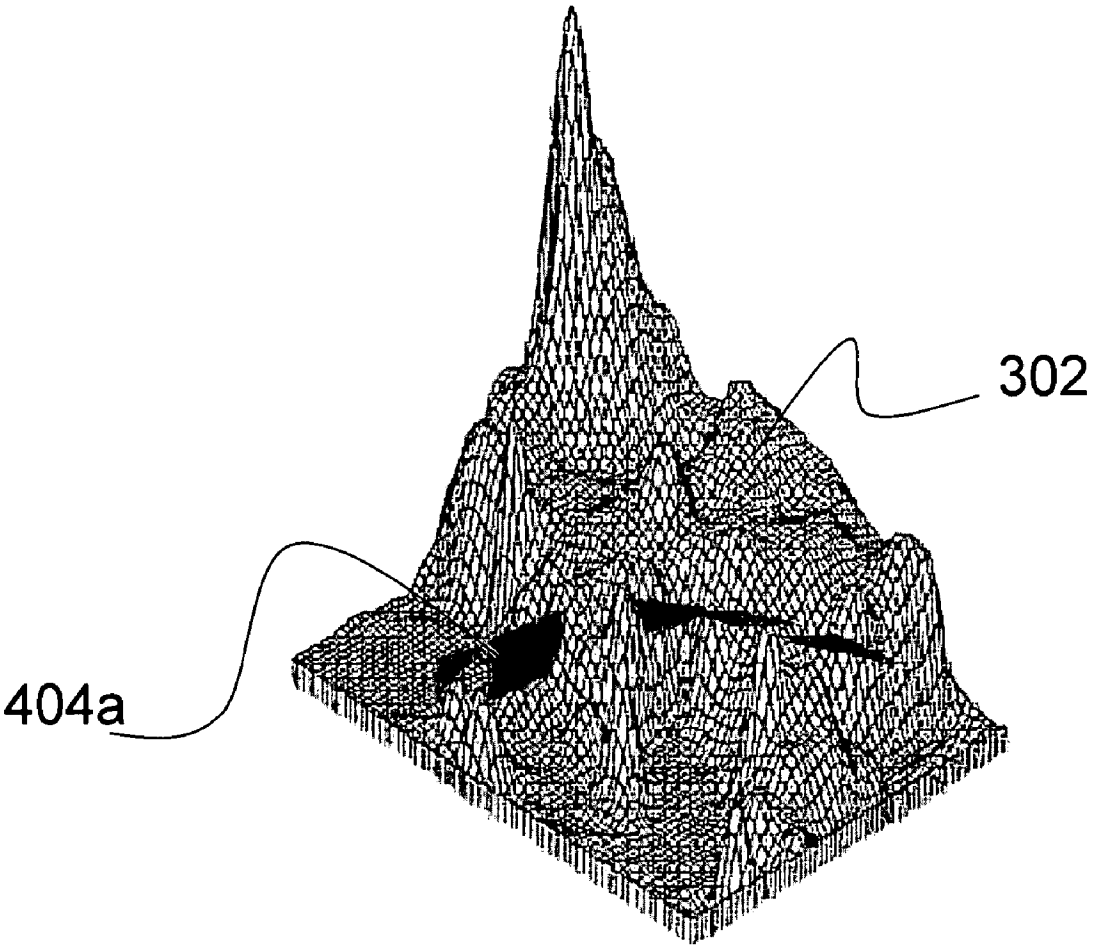
FIG. 5 is an exemplary illustration of the trajectory surface, showing shadowed areas eliminated from the trajectory surface.

Referring to FIG. 2, next an act of eliminating shadowed images 212 is performed. When the trajectory surface 404 "hits" the topographical map surface 302, it will do so in a specific direction of travel. The "hit" portion of the topographical map surface 302 acts like an occlusion to light rays, leaving a "shadow" where no payload will fall. These shadowed images are eliminated from the rendered image. FIG. 5 shows how the shadowed areas are eliminated from the trajectory surface 404*a*, the effect of shadowing, assuming the direction of launch was toward the viewer from behind the nearby hills.

The remaining visible trajectory surface 404*a* constitutes the locus of pixels or area, which can be hit from the launch site.

One skilled in the art will appreciate that by swapping the launch site and the target site, the disclosed system and method can determine the locus of launch sites that can be used to hit a given target.

Further, one skilled in the art will appreciate that there are many techniques that may be employed to reach the results described in the system and method detailed above. Therefore, the following details of implementation are meant as a guide only are not to be understood as the only techniques available for reaching the results described above.

In one aspect, the act of determining a list of trajectories available from this launch site 204 may be accomplished by varying the azimuth values. The minimum and maximum azimuth values may be determined by the limitations of the lunch equipment or other situational constraints. The number of steps between the maximum and minimum azimuth values is also user selectable and herein referred to as nTrajectories. An angular difference between adjacent trajectories can be fixed or may vary. Each trajectory is computed as a set of (x,y,z) positions in 3-space. The positions correspond to the point's locations of the surface of interest and its altitude at some fixed level. If the length of the trajectory is large enough, provision must be made to incorporate a curved-earth model such as the World Geodetic System 1984 (WGS-84). Each trajectory will optimally have the same number of points in its path.

WGS-84 is a method for describing the earth's surface that was developed by Eurocontrol. Eurocontrol is located at Rue de la Fusée, 96, B-1130 Brussels, Belgium.

In another aspect, the act of defining the first surface 206 is performed by joining points on adjacent pairs of trajectories so that each pair of trajectories defines a triangle strip. The direction of the triangles should be chosen to minimize error. The result is nTrajectories-1 strips, each with nTrajectoryPoints-1*2 triangles. As can be appreciated by one skilled in the art, * denotes multiplication. The collection of the nTrajectories-1 strips forms the trajectory mesh. Further, the first surface may be defined such that any first surface vertex (x,y,z) maps to the same value in pixel space as the corresponding height field value at (x,y).

In yet another aspect, the act of rendering a topographical map surface 208 is performed using an Application Programming Interface (API) such as OpenGL or Direct3D. In rendering a topographical map surface height field, all terrain areas are preferably within the graphics window boundaries, and the graphics engine 106, shown in FIG. 1, is set to generate a view of the topographical map surface from a point above the highest point on the topographical map surface. The topographical map surface is rendered preferably using all three vertex values (x,y,z) where z is the height of the vertex. Preferably, the depth buffer (also called the Z-buffer) should be enabled. In one embodiment, only one color C1 is used for the topographical map surface.

In another aspect, the act of rendering the first surface 210 is performed using an orthographic projection. The first surface 210 is rendered in the same manner as the topographical map surface, except a different color, C2, is chosen for the first surface.

In yet another aspect, the act of eliminating shadowed images 212 comprises an act of reading back the color buffer 126 into the processor 202. The result is that the color buffer will contain pixels of two colors (or shades, such as in grayscale), C1 and C2. C1 pixels represent elements of the topographical map surface that have a higher elevation (lower Z value) than the corresponding trajectory surface value. In other words, C1 patches are areas that are not "overflown" by the trajectories represented by the trajectory surface. In these areas, the elevation of the topographical surface is higher than that of the trajectory surface, so the ballistic projectile will hit the terrain and fail to complete its flight. C2 patches are areas where the trajectory surface is higher than the elevation, so a trajectory that is part of the trajectory surface is likely to pass over the terrain, represented by the topographical map surface, successfully. The color buffer is examined to determine and identify discrete areas of C1 and C2 coloration.

The act of eliminating shadowed images 212 further comprises an act of determining shadows. A "hole" is defined in the color buffer as an area containing only C1 colors. If a trajectory is traced outward from the launch point, and encounters any hole along its path (i.e., an obstruction in the topographical map surface), that trajectory should be terminated at the first hole pixel encountered. It is not possible for a trajectory to travel "below" the topographical map surface for a time and reappear above the topographical map surface at a later point. Consequently, for all holes, a triangle is determined, wherein the edges of the triangle has one vertex at the firing location and one vertex at each side of a hole at its most distant point. The extension of this triangle away from the launch location represents a "shadow" of the hold. No trajectory falling inside this shadow can be considered for a destination regardless of the pixel color beneath it.

Further, the act of eliminating shadowed images 212 may comprise an act of determining an intersection of the trajectory surface as modified by the shadows. In such an aspect, the pixels represent all possible target points, given the initial firing parameters.

In another aspect, the following assumptions are used: the terrain is a function (i.e., each elevation associated with the terrain height field corresponds to, at most, one x, y spot); the trajectory mesh and its corresponding surface is continuous in such a way that the trajectory surface is also a function (i.e. each elevation associated with the trajectory surface corresponds to, at most, one x, y spot); the terrain elevations represent discretization of actual elevation values.

One skilled in the art will appreciate that there are many ways to describe and implement the system and method described above. Another description and implementation is shown in FIG. 6.

Figure 6:
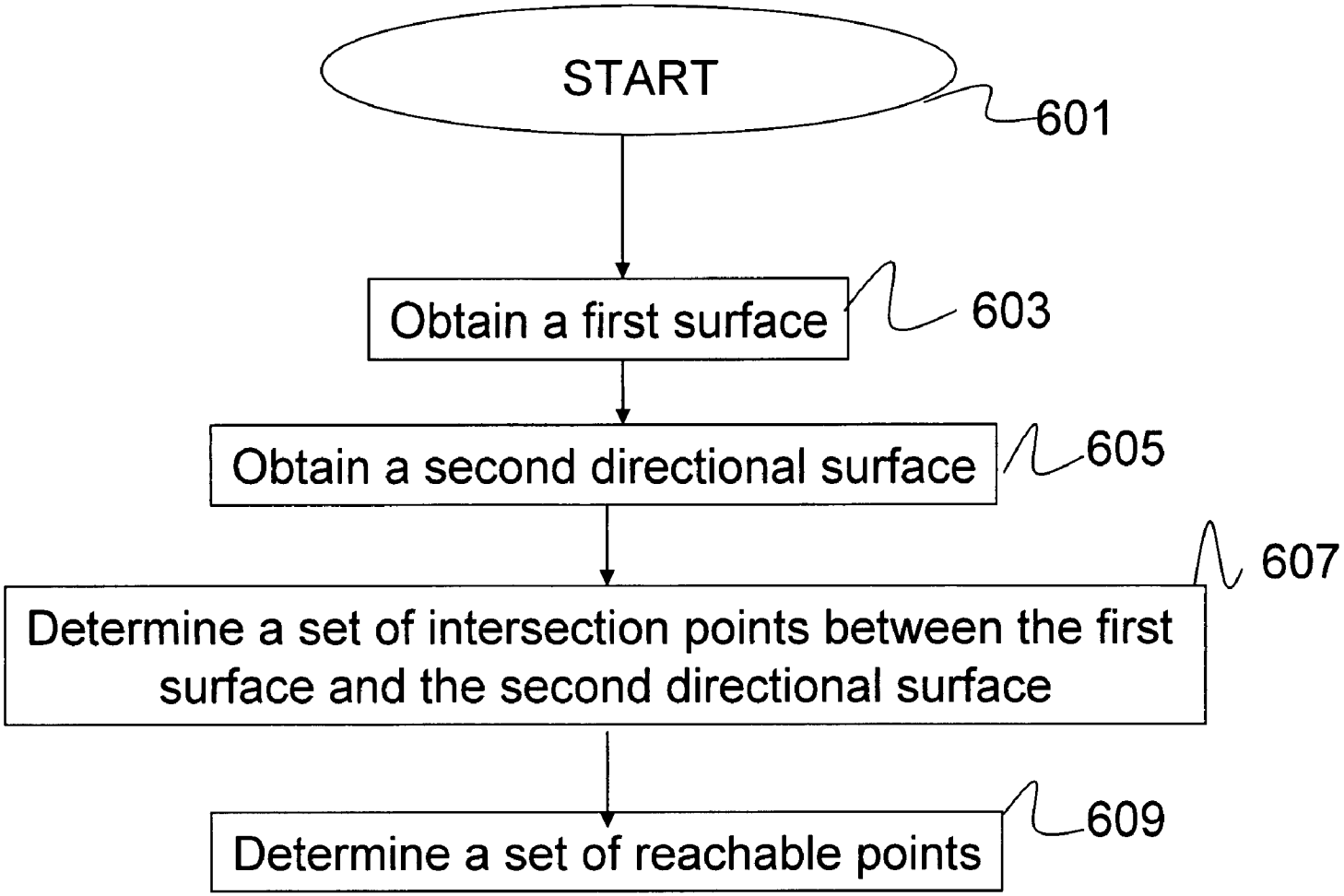
FIG. 6 is flow chart illustration another aspect of the present invention.
Figure 7:
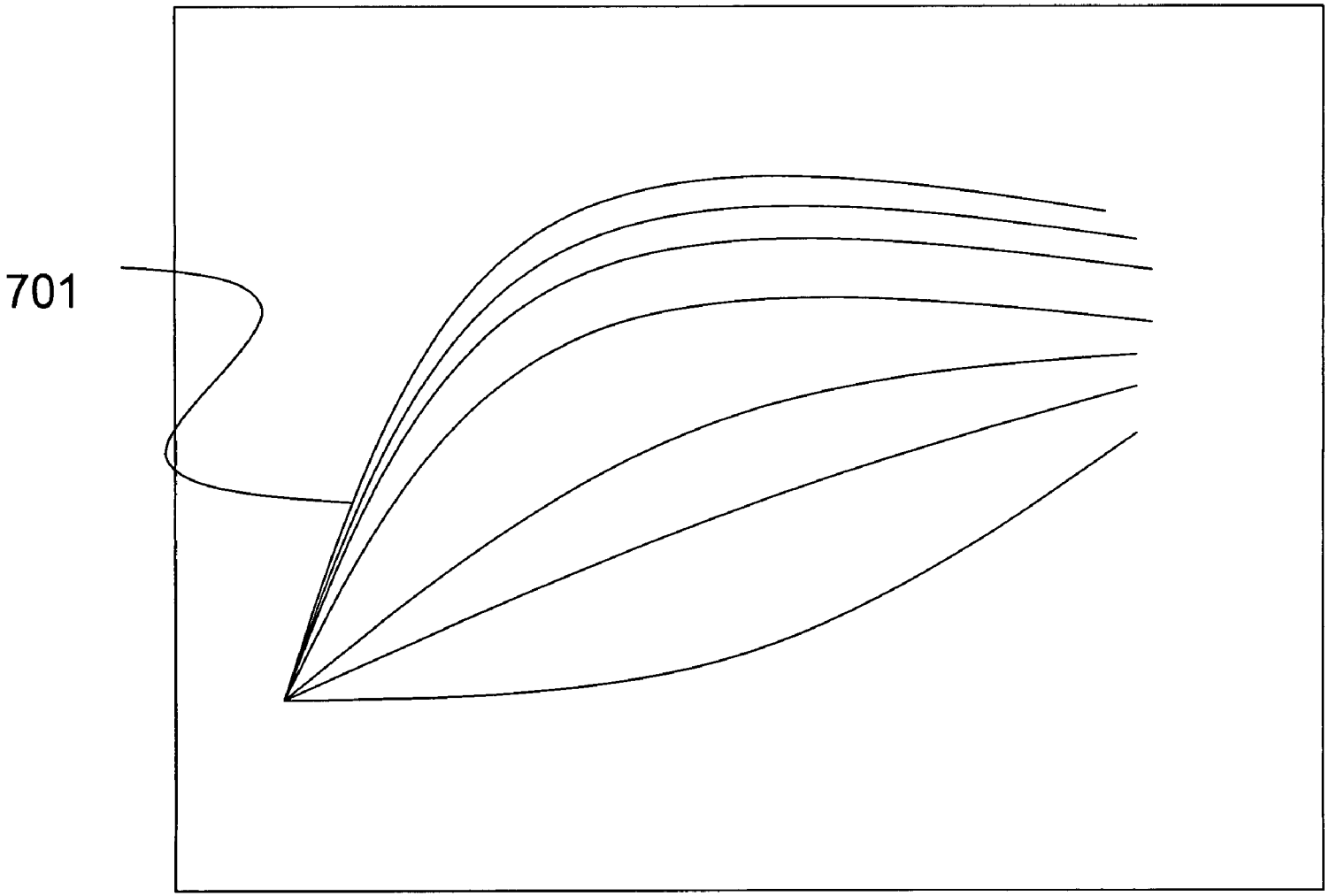
FIG. 7 is an illustration of a second directional surface being defined by a set of ordered curves in space.

Referring back to FIG. 1, the processor 102 may contain software for performing the acts shown in FIG. 6. After a starting act 601, an act of obtaining a first surface 603 is performed. In one embodiment, the first surface is a topographical map received from the topographical map information 124 (shown in FIG. 1) as described above. Next an act of obtaining a second directional surface 605 is performed. In one embodiment, a directional surface is created by ordering points of a surface. One example of a directional surface is a parametric surface. For a parametric surface, each point on the surface is determined uniquely by two variables, one variable having a first dimension, and the second variable defining a direction in a second dimension. In one embodiment as shown in FIG. 7, the second directional surface is defined by a set of ordered curves in space for which the projection onto a plane of interest is non-intersecting 701. An example of such a projection is shown in FIG. 7. For example, a directional surface may be defined by the trajectory engine 104 (shown in FIG. 1). In one embodiment, the first and second surfaces comprise sets of discrete points.

Next an act of determining a set of intersection points between the first surface and the second directional surface 607 is performed. In one embodiment, the set of intersection points has an order in a first dimension and a direction in the second dimension based on the directionality of the second surface. In one embodiment, the act of determining a set of intersection points further comprises an act of using a specialized computer having a Z-buffer as described above.

Figure 8:
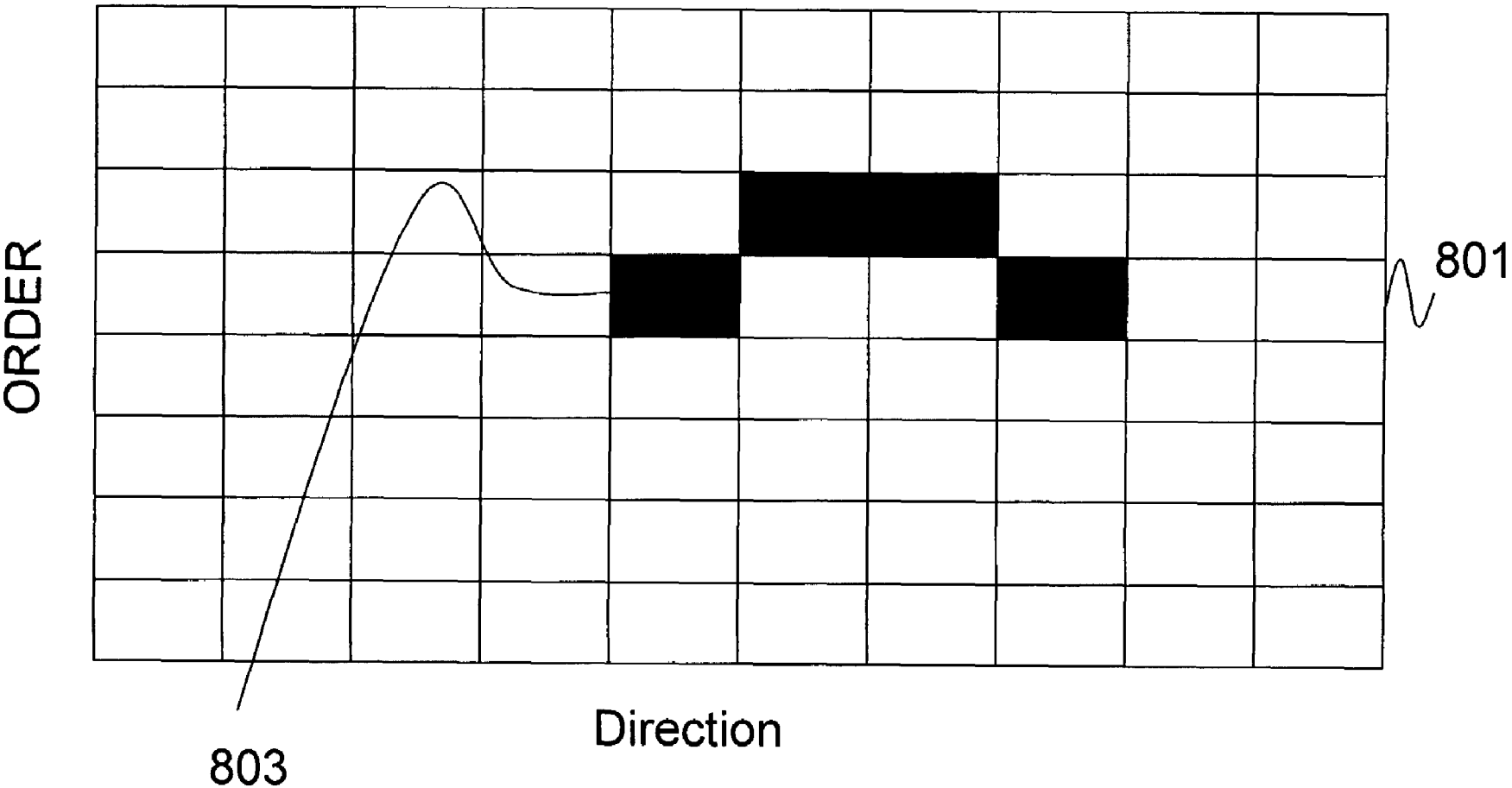
FIG. 8 is an illustration of a rectangular grid, mapping the intersection of the first and second surfaces corresponding to the order and direction.

Next an act of determining a set of reachable points 609 is performed. In one embodiment, the set of reachable points is determined from the set of intersection points, wherein the set of reachable points has only one point per order. For example as shown in FIG. 8, the intersection of the first and second surfaces can be mapped into a rectangular grid 801 corresponding to the order and direction. In some cases, the intersection may have more than one direction value for each order value. After mapping the intersection into a rectangular grid, the smallest direction value 803 for each order value is determined. The determination of the smallest direction value is performed for each order value. The resulting set of points that is the set of reachable points.

One skilled in the art will appreciate that while the system and method has been described from the launch point's point of view, the converse situation is possible and requires little change in the method. In this case, the computation would begin with a target point and the trajectories would be computed backwards from that point toward an area of launch points.

Finally, as can be appreciated by one skilled in the art, the present invention also comprises a computer program product including instruction means for performing the operations of the method described herein. The computer program product generally represents computer-readable code stored on a computer-readable medium such as an optical storage device, e.g., a compact disc (CD) or digital versatile disc (DVD), or a magnetic storage device such as a floppy disk or magnetic tape. Other, non-limiting examples of computer-readable media include hard disks, read-only memory (ROM), and flash-type memories.

The term "instruction means" as used with respect to this invention generally indicates a set of operations to be performed on a computer, and may represent pieces of a whole program or individual, separable, software modules. Non-limiting examples of "instruction means" include computer program code (source or object code) and "hard-coded" electronics (i.e. computer operations coded into a computer chip). As described above, the "instruction means" may be stored in the memory of a computer or on a computer-readable medium such as a floppy disk, a CD-ROM, and a flash drive.

Figure 9:
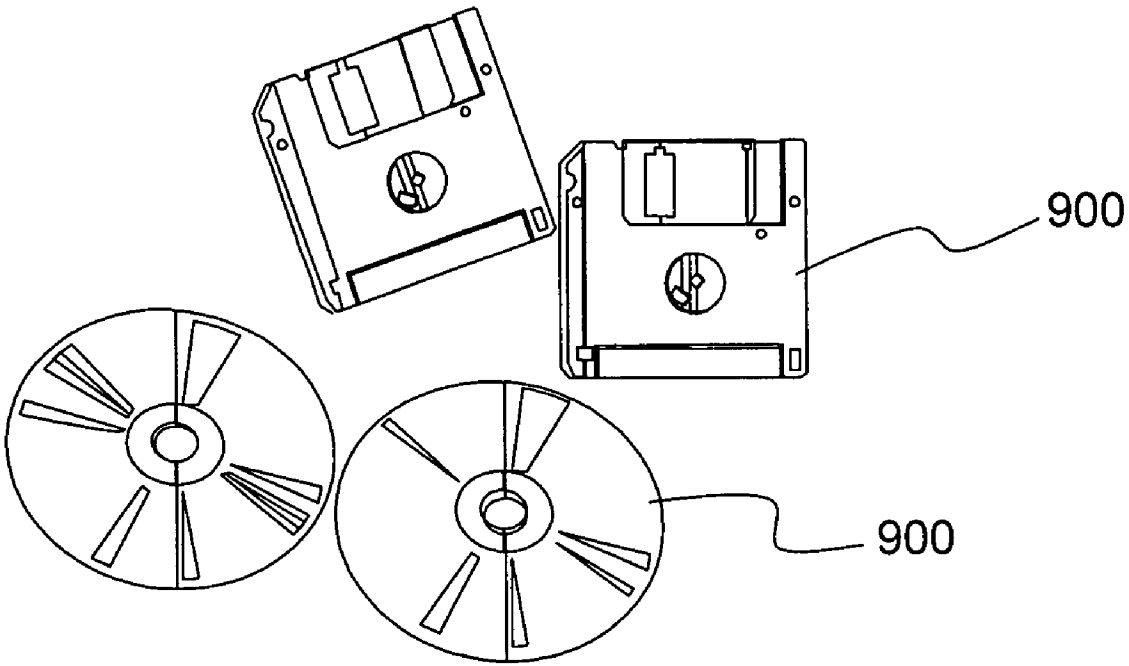
FIG. 9 is an illustrative diagram of a computer program product embodying the present invention.

An illustrative diagram of a computer program product embodying the present invention is depicted in FIG. 9. The computer program product 900 is depicted as an optical disk such as a CD or DVD. However, as mentioned previously, the computer program product generally represents computer-readable instructions stored on any compatible computer-readable medium.

What is claimed is:

1. A computer implemented method for determining an area that is reachable from a first point comprising an act of causing a computer having a processor and a memory module encoded with instruction means to execute the instruction means and cause the processor to perform operations of:

defining a first surface from a trajectory engine;

rendering a topographical map from topographical map information utilizing a graphics engine;

rendering the first surface utilizing a graphics engine; and eliminating shadowed images utilizing a color buffer;

obtaining a second directional surface;

determining a set of intersection points between the first surface and the second directional surface, wherein the set of intersection points has an order in a first dimension and a direction in a second dimension based on the directionality of the second directional surface; and determining a set of reachable points from the set of intersection points, wherein the set of reachable points has a point per order.

2. The method of claim 1, wherein the act of obtaining a second directional surface further comprises an act of:

defining the second directional surface by a set of ordered curves in space, in which the projection onto a plane of interest is non-intersecting.

3. The method of claim 2, wherein the act of defining further comprises an act of:

selecting the set of ordered curves in space from a set of trajectories.

4. The method of claim 3, wherein the act of selecting further comprises an act of:

determining the set of trajectories from a set of ballistic trajectories.

5. The method of claim 1, wherein the act of obtaining a first surface comprises an act of:

selecting the first surface from a set of topological maps.

6. The method of claim 1, wherein the act of obtaining further comprises an act of:

discretizing the first surface and the second directional surface, such that the first surface and the second directional surface comprises discrete points that represent the surfaces.

7. The method of claim 1, wherein the act of determining a set of reachable points further comprises acts of:

mapping the set of intersection points into a rectangular grid corresponding to order and direction, wherein each intersection point has an order value and a direction value; and determining for each direction value the smallest order value, wherein the direction value and smallest order value comprises one of the reachable points in the set of reachable points.

8. The method of claim 1, wherein the act of determining a set of intersection points comprises an act of determining whether and where the first surface intersects the second surface using a depth buffer.

9. An apparatus for computing reachable areas comprising:

a processor, wherein the processor comprises:

a trajectory engine; and a graphics engine connected with the trajectory engine; and a memory module connected with the processor, wherein the memory module comprises:

topographical map information; and a color buffer, wherein the processor comprises software for performing acts of:

defining a first surface from the trajectory engine;

rendering a topographical map from the topographical map information utilizing the graphics engine;

rendering the first surface utilizing the graphics engine; and eliminating shadowed images utilizing the color buffer.

10. The apparatus of claim 9, wherein the act of defining a first surface includes acts of:

selecting a starting and ending azimuth value; and varying an azimuth value between the starting and ending azimuth values.

11. The apparatus of claim 9, wherein the act of eliminating shadowed images includes acts of:

reading back the color buffer into the processor, wherein the color buffer contains pixels of a first color and a second color, wherein the first color represents elements where the topographical map has a lower Z value than the corresponding first surface, and the second color represents elements where the topographical map has a higher Z value that the corresponding first surface;

determining a shadow from the point where the color buffer contains only the first color; and eliminating the areas in the shadow.

12. An apparatus for computing reachable areas comprising:

a processor, wherein the processor comprises:

a trajectory engine; and a memory module connected with the processor, wherein the memory module contains topographical map information, wherein the processor comprises software for performing acts of:

obtaining a first surface from the topographical information and a second directional surface from the trajectory engine;

determining a set of intersection points between the first surface and the second directional surface, wherein the set of intersection points has an order in a first dimension and a direction in a second dimension based on the directionality of the second directional surface; and determining a set of reachable points from the set of intersection points, wherein the set of reachable points has one point per order.

13. The apparatus of claim 12, wherein the act of obtaining a second directional surface further comprises an act of:

receiving a set of ordered curves in space from the trajectory engine, in which the projection onto a plane of interest is non-intersecting.

14. The apparatus of claim 12, wherein the act of receiving further comprises an act of:

selecting the set of ordered curves in space from a set of trajectories in the trajectory engine.

15. The apparatus of claim 14, wherein the act of selecting further comprises an act of:

determining the set of trajectories from a set of ballistic trajectories in the trajectory engine.

16. The apparatus of claim 12, wherein the act of obtaining further comprises an act of:

discretizing the first surface and the second directional surface, such that the first surface and the second directional surface comprises discrete points that represent the surfaces.

17. The apparatus of claim 12, wherein the act of determining a set of reachable points further comprises acts of:

mapping the set of intersection points into a rectangular grid corresponding to order and direction, wherein each intersection point has an order value and a direction value; and determining for each direction value the smallest order value, wherein the direction value and smallest order value pair comprises one of the reachable points in the set of reachable points.

18. The apparatus of claim 12, wherein the act of determining a set of intersection points comprises an act of:

using a computing device having a Z-buffer.

19. A computer program product for determining an area that is reachable from a first point, the computer program product comprising computer-readable instruction means encoded on a computer-readable medium that are executable by a computer having a processor for causing the processor to:

define a first surface from a trajectory engine;

render a topographical map from topographical map information utilizing a graphics engine;

render the first surface utilizing a graphics engine;

eliminate shadowed images utilizing a color buffer;

obtain a second directional surface;

determine a set of intersection points between the first surface and the second directional surface, wherein the set of intersection points has an order in a first dimension and a direction in a second dimension based on the directionality of the second directional surface; and determine a set of reachable points from the set of intersection points, wherein the set of reachable points has a point per order.

20. The computer program product of claim 19, wherein the instruction means for causing a computer to obtain a second directional surface further comprises instruction means for causing a computer to define the second directional surface by a set of ordered curves in space, in which the projection onto a plane of interest is non-intersecting.

21. The computer program product of claim 20, wherein the instruction means for causing a computer to define further comprises instruction means for causing a computer to select the set of ordered curves in space from a set of trajectories.

22. The computer program product of claim 21, wherein the instruction means for causing a computer to select further comprises instruction means for causing a computer to determine the set of trajectories from a set of ballistic trajectories.

23. The computer program product of claim 19, wherein the instruction means for causing a computer to obtain a first surface further comprises instruction means for causing a computer to select the first surface from a set of topological maps.

24. The computer program product of claim 19, wherein the instruction means for causing a computer to obtain further comprises instruction means for causing a computer to discretize the first surface and the second directional surface, such that the first surface and the second directional surface comprises discrete points that represent the surfaces.

25. The computer program product of claim 19, wherein the instruction means for causing a computer to determine a set of reachable points further comprises instruction means for causing a computer to:

map the set of intersection points into a rectangular grid corresponding to order and direction, wherein each intersection point has an order value and a direction value; and determine for each direction value the smallest order value, wherein the direction value and smallest order value comprises one of the reachable points in the set of reachable points.

26. The computer program product of claim 19, wherein the instruction means for causing a computer to determine a set of intersection points further comprises instruction means for causing a computer to determine whether and where the first surface intersects the second surface using a Z-buffer.

27. The method of claim 1, further comprising acts of:

selecting the first surface from a set of topological maps; and defining the second directional surface by a set of ordered curves in space, in which the projection onto a plane of interest is non-intersecting.

* * * * *